United States Patent [19]

Day

[11] 4,202,271

[45] May 13, 1980

[54] SAFE AND ARM DEVICE

[75] Inventor: John H. Day, Pacific Palisades, Calif.

[73] Assignee: The United States of America as represented by the Secretary of the Army, Washington, D.C.

[21] Appl. No.: 927,781

[22] Filed: Jul. 25, 1978

[51] Int. Cl.[2] ..... F42C 15/24; F42C 15/40

[52] U.S. Cl. ..... 102/247; 102/260; 102/262

[58] Field of Search ..... 102/262, 247, 248, 249, 102/256, 231, 260

[56] References Cited

U.S. PATENT DOCUMENTS

| | | | |
|---|---|---|---|
| 2,912,933 | 11/1959 | Rabinow | 102/248 |
| 2,958,286 | 11/1960 | Sheeley | 102/248 |
| 3,000,315 | 9/1961 | Anastasia et al. | 102/262 X |
| 3,004,491 | 10/1961 | Place et al. | 102/262 |
| 3,368,487 | 2/1968 | O'Connor et al. | 102/249 X |
| 3,416,894 | 12/1968 | Brooks et al. | 102/247 |
| 3,498,225 | 3/1970 | Voida et al. | 102/248 |
| 3,554,128 | 1/1971 | Hoelzen et al. | 102/248 |
| 3,906,861 | 9/1975 | Hamilton et al. | 102/249 |

*Primary Examiner*—David H. Brown
*Attorney, Agent, or Firm*—William G. Gapcynski; Werten F. W. Bellamy; James T. Deaton

[57] ABSTRACT

A safe and arming device used with electrically operated fuses of a missile and including a housing with an acceleration responsive device rotatably mounted therein between safe and arming positions and biased into the safe position by a spring and actuatable to the arming position when accelerated at a predetermined rate, latching means which latches the acceleration device in the armed position and reset means which releases the latching means to allow the device to be reset into the safe position.

7 Claims, 12 Drawing Figures

SAFE AND ARM DEVICE

DEDICATORY CLAUSE

The invention described herein may be manufactured and used by or for the Government for governmental purposes without the payment of any royalties thereon.

BACKGROUND OF THE INVENTION

In a missile in which there are hazardous systems that are not desired to be actuated until after launch of the missile, there is a need for a safe and arm device which prevents inadvertent activation of the gas generators and the separation thrusters of the missile.

Therefore, it is an object of this invention to provide a safe and arm device which is actuated to an arming position by acceleration of the device upon launch of the missile.

Another object of this invention is to provide a safe and arming device that can be easily tested for its reliability and to be able to accurately check the torque required to move the acceleration device from a safe position to the arming position.

Still another object of this invention is to provide a device that has a latching mechanism therein for latching the acceleration device in the armed position with a simple reset means for allowing the latch means to be reset in the unlatched position for test purposes.

Other objects and advantages of this invention will be obvious to those skilled in this art.

SUMMARY OF THE INVENTION

In accordance with this invention, a housing is provided that has chambers therein with a first rotary shaft mounted for rotation in the housing and having a rotary switch mounted at one end of the rotary shaft and an unbalance rotor mounted near another end of the rotary shaft. A spring biases the rotor into the unlatched or safe position and when predetermined torque is applied to the rotor, the rotor is biased against the spring tension into an arming position. A latch is also pivotally mounted in the housing and contacts the rotor when actuated to the arming position to hold the rotor in the arming position. The latch has an arm that is contacted by a reset button that is spring biased out of engagement with the latch arm until depressed by an operator. The rotary switch is interconnected to detonators that are mounted in the rotor and aligned or connected to outlets in the housing for igniting appropriate fuses when connected thereto.

DESCRIPTION OF THE PREFERRED EMBODIMENT

Figure 3:
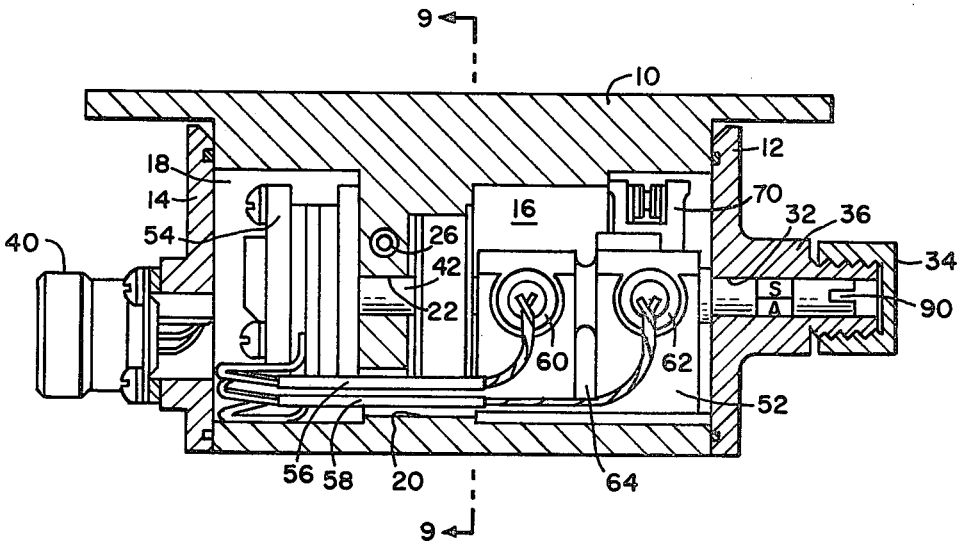
FIG. 3 is a sectional view along line 3—3 of FIG. 2.
Figure 6:
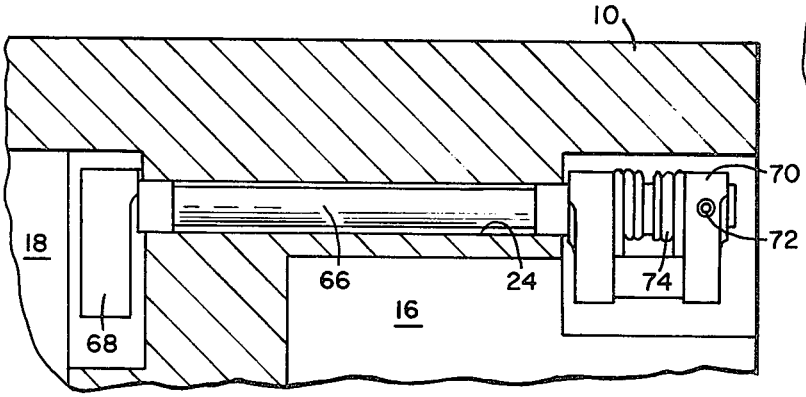
FIG. 6 is a sectional view along line 6—6 of FIG. 5.
Figure 7:
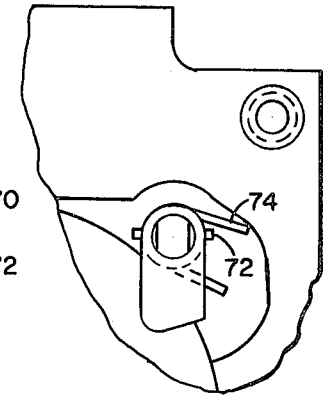
FIG. 7 is an end view illustrating the latch and its spring mechanism.
Figure 8:
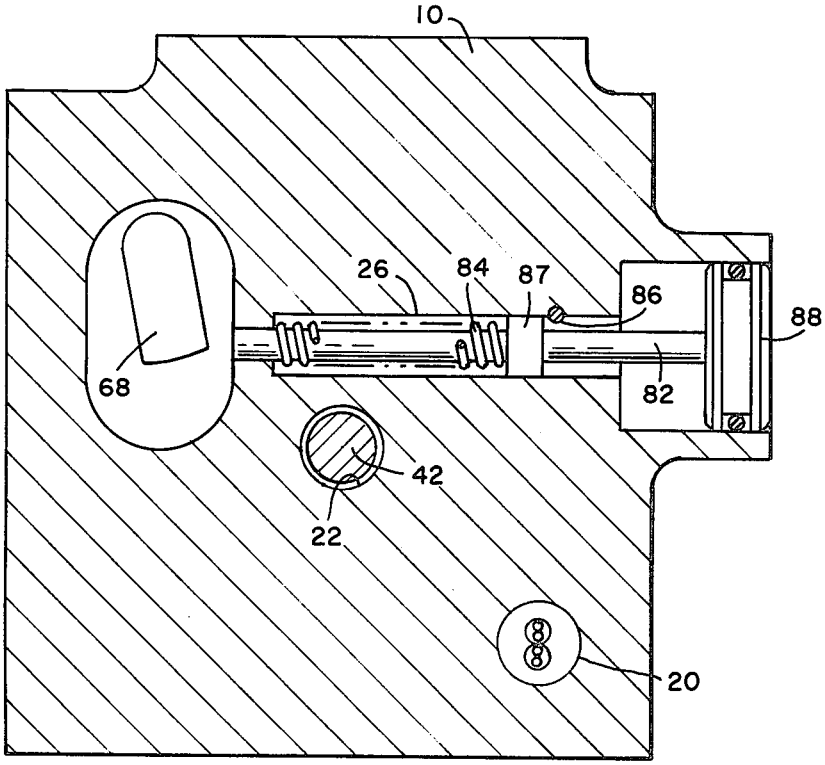
FIG. 8 is a sectional view along line 8—8 of FIG. 1.
Figure 12:
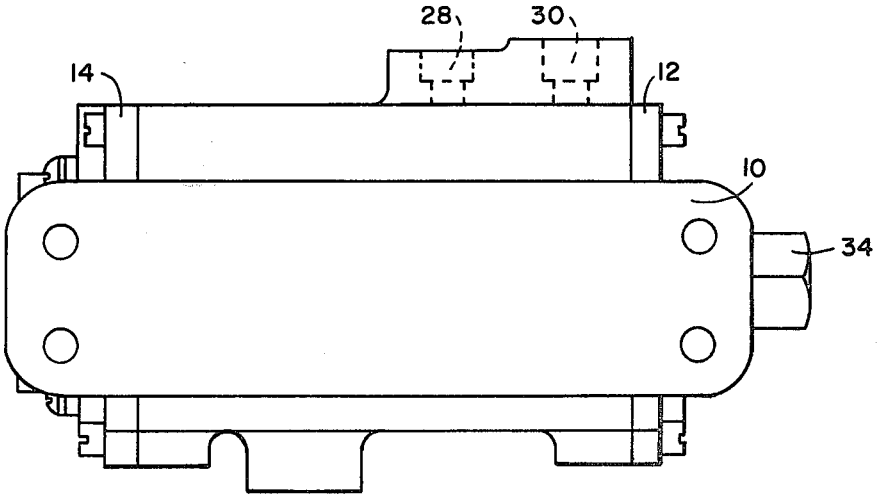
FIG. 12 is a top view of the safe and arming device according to this invention.

Referring now to the drawing, the safe and arming device includes a housing 10 with end covers 12 and 14. Chambers 16 and 18 (see FIG. 3) are located in the housing adjacent each end cover. Bores 20, 22 (see FIG. 3) and 24 (see FIG. 6) interconnect chambers 16 and 18. Housing 10 also has stepped bore 26 (see FIG. 8) and outlet ports 28 and 30 (see FIG. 12). End cover 12 has a bore 32 therethrough and an end cap 34 threadedly mounted on flange 36. Flange 36 has a viewing window 38 made therein for observing the safe and arming positions of the safe and arming device. End cover 14 has electrical connecting means 40 for connecting appropriate electrical circuits to the safe and arming device.

Figure 1:
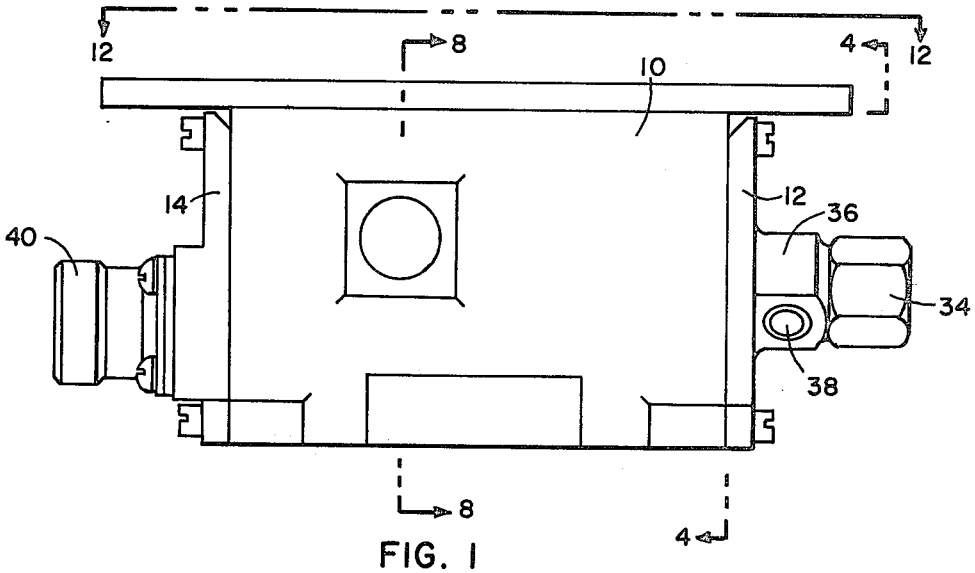
FIG. 1 is a side view of the safe and arming device according to this invention.
Figure 2:
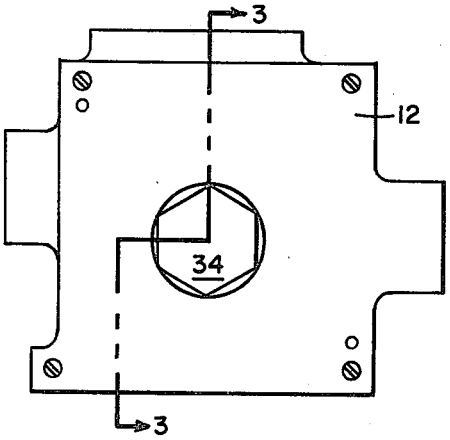
FIG. 2 is an end view of the safe and arming device according to this invention.
Figure 9:
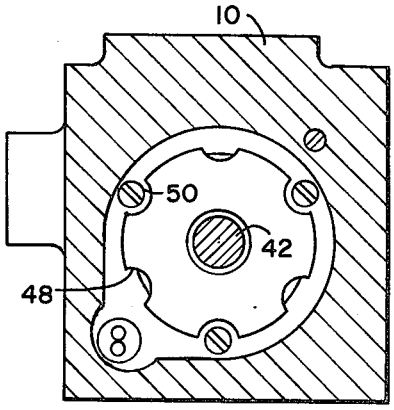
FIG. 9 is a sectional view along line 9—9 of FIG. 3.
Figure 11:
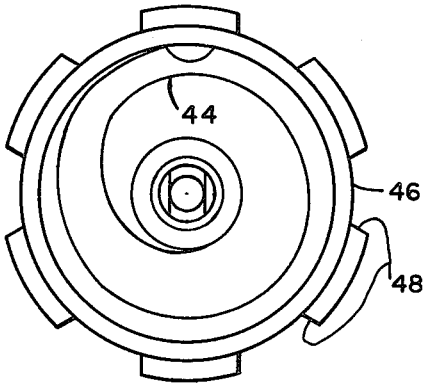
FIG. 11 is a view illustrating the spring interconnection between the rotary shaft and the biasing spring for biasing the rotor in an unarming direction.

Rotary shaft 42 is rotatably mounted in housing 10 at bore 22 and by bore 32 of end cover 12. A spiral wound clock type spring 44 is secured at one end to rotary shaft 42 and at the other end to retainer housing 46 (see FIG. 11). Retainer housing 46 is rotatably mounted relative to shaft 42 and has six cutouts 48 in the outer periphery thereof that are 60° apart to allow retainer 46 to be adjusted in housing 10. Retainer 46 is secured in housing 10 by screws 50 (see FIG. 9). Retainer housing 46 is first positioned with the proper tension being applied by spring 44 and then screws 50 are installed. An unbalanced rotor assembly 52 is mounted on shaft 42 and is unbalanced such that when mounted in a missile, actual acceleration of the missile imposes a moment on the rotor in a direction for rotating shaft 42 as well as rotor 52 to the armed position. When the acceleration of the missile and the corresponding moment are sufficient to overcome the opposing moment of rotary spring 44, rotor 52 rotates to the arming position. Shaft 42 has indicators "A" and "S" marked thereon at flange 36 (see FIG. 3) to be viewed through window 38 (see FIG. 1). The "A" stands for armed and "S" stands for safe.

Figure 10:
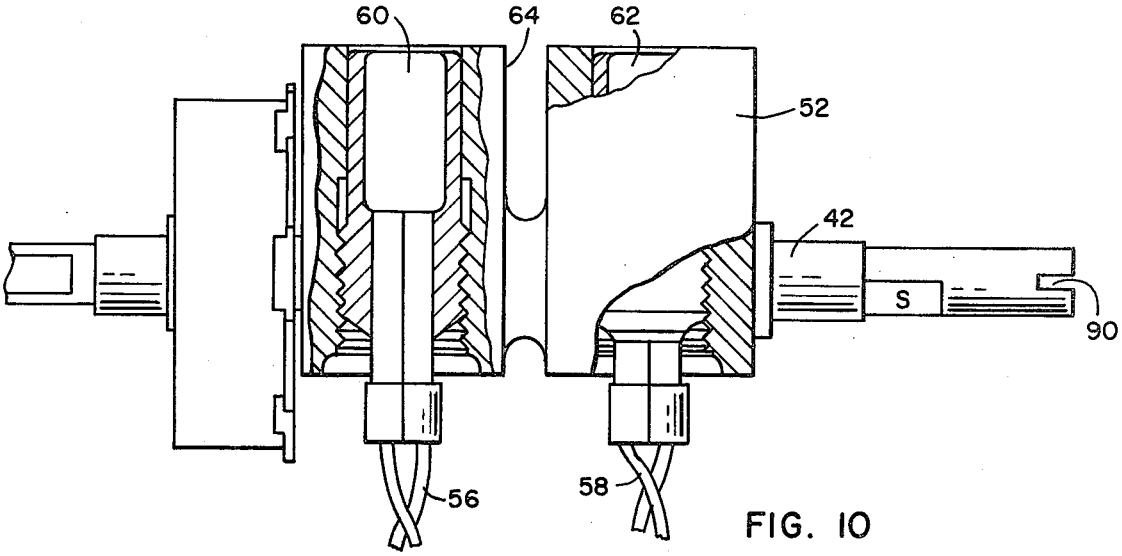
FIG. 10 is a view partially in section illustrating the rotor and its shaft with the spring biasing mechanism.

Another end of shaft 42 has a conventional rotary type switch 54 mounted relative thereto and to the housing and is connected by test and power leads through connector means 40 and through leads 56 and 58 to conventional type explosive detonators 60 and 62 that are mounted in rotor 52. Rotor 52 has a groove 64 (see FIG. 10) that is located between detonators 60 and 62 to prevent sympathetic detonation of a second detonator when a first detonator is fired.

Figure 4:
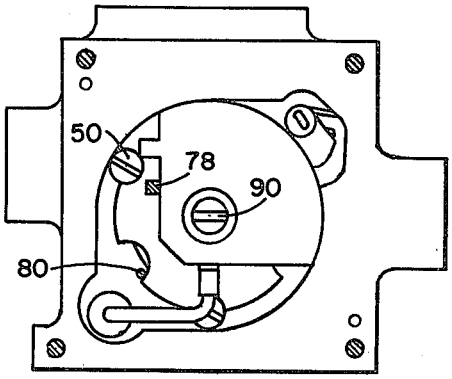
FIG. 4 is a view along line 4—4 of FIG. 1.

A latch assembly for rotor 52 includes a shaft 66 (see FIG. 6) rotatably mounted in bore 24 and shaft 66 has unlatching arm 68 integrally secured to one end thereof and a latching arm 70 splined to the other end of shaft 66 and secured in place by pin 72 that extends through arm 70 and shaft 66. A spring 74 is mounted about shaft 66 and opposite ends thereof contact housing 10 and latching arm 70 to bias latching arm 70 into contact with rotor 52. When in the armed position illustrated in FIG. 5, latch arm 70 engages stop 76 on rotor 52 and prevents rotor 52 from moving to the safe position until latch arm 70 is moved out of latching position. End cover 12 has stops 78 and 80 thereon (see FIG. 4) for limiting movement of rotor 52 between the safe and arming positions. A latch releasing mechanism for latch arm 70 includes a shaft 82 (see FIG. 8) mounted in bore 26 and spring biased outwardly by spring 84. Shaft 82 is maintained in bore 26 by pin 86 and flange 87. Shaft 82 has a push button end 88 for actuating shaft 82 to contact unlatching arm 68 and rotate shaft 66 and latch arm 70 to release latch arm 70 from stop 76 and rotor 52 to unlatch the rotor and allow spring 44 to return rotor 52 to the safe position.

Leads 56 and 58 of detonators 60 and 62 have the lead wires thereof connected to rotor switch 54 such that when rotor 52 is in the safe position, the detonator lead wires of each of leads 56 and 58 are shorted together and to housing 10. Also, the detonator body of each detonator 60 and 62 is shorted to housing 10 to prevent an electrostatic discharge path through the sensitive explosive mixture of detonators 60 and 62. The output ends of detonators 60 and 62 are pointed upward toward the top of housing 10 when in the safe position so that the housing will confine the output from detonators 60 and 62 if they are accidentally discharged. This prevents external damage or fragmentation.

For bench checkout of the device, to determine arming torque and to permit the device to be placed in the armed condition for bridgewire continuity/resistance checks of electrical detonators 60 and 62, cap 34 (see FIG. 3) is removed to expose screwdriver slot 90 in the end of rotor shaft 42. With cap 34 removed, an appropriate torque wrench with screwdriver adapter engaged to screwdriver slot 90, the torque required to start rotor shaft movement is measured and then the amount of torque required to rotate shaft 42 and rotor 52 to the arming position are measured. With the device latched in the arming position by latch arm 70, electrical detonators 60 and 62 can have bridgewire continuity/resistance checks made as well as other desired electrical checks. After these checks have been made with the device in the armed position, the device can be returned to the safe condition by pressing button 88 which moves shaft 82 into engagement with arm 68 which in turn actuates latch 70 through shaft 66 to unlatch rotor 52. With rotor 52 unlatched, spring 44 biases rotor 52 back into the safe position.

Figure 5:
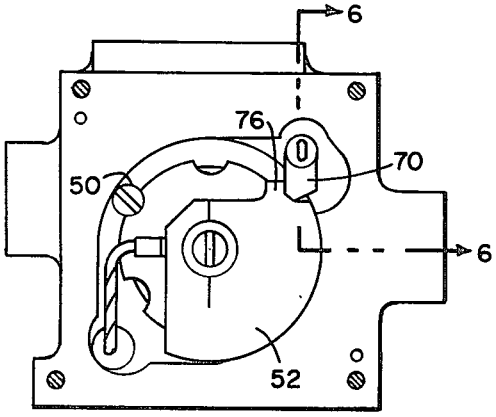
FIG. 5 is a view illustrating the rotor and latch in the armed position.

In operation, when the safe and arming device is installed in a missile, and the missile is launched and attains a predetermined acceleration to impose a moment on rotor 52, rotor 52 is rotated against the bias of spring 44 to the latched position illustrated in FIG. 5. In this position, switch 54 has interconnected the electrical leads to detonators 60 and 62 so that these detonators can be fired as desired. Groove 64 in rotor 52 prevents the shock of a first one of detonator 60 and 62 from causing detonation of the other detonator. Therefore, detonators 60 and 62 can be used for providing control of different parts of the missile at different times after launching of the missile through output ports 28 and 30.

I claim:

1. A safe and arming device comprising a housing having an unbalanced rotor rotatably mounted by a rotor shaft in said housing; said shaft having spring biasing means biasing said rotor to a safe position, said rotor being unbalanced and rotatable to an arming position; latching means pivotably mounted in said housing and engaging said rotor when said rotor has been rotated to said arming position for latching said rotor in said arming position; and resafe means mounted in said housing and engageable with said latching means for rotating said latching means away from said rotor to unlatch said rotor and allow said spring means to bias said rotor into said safe position.

2. A safe and arming device as set forth in claim 1, wherein said rotor has detonators mounted therein.

3. A safe and arming device as set forth in claim 2, wherein said spring biasing means is adjustably mounted in said housing.

4. A safe and arming device as set forth in claim 3, wherein said shaft has one end with tool engaging means for rotating said shaft against the bias of said spring means to check the torque required to rotate said shaft from the safe to the arming position.

5. A safe and arming device as set forth in claim 3, wherein said housing has an end cover with a sight window, and said shaft has indica thereon that can be viewed through said sight window to determine the position of said rotor in said housng.

6. A safe and arming device as set forth in claim 3, wherein said rotor has a groove therein for preventing sympathetic detonation of the second detonator when the first detonator is fired.

7. A safe and arming device as set forth in claim 6, wherein said detonators point into said housing when in the safe position and are aligned with output ports in said housing when in said arming position.

* * * * *